US007475875B2

(12) United States Patent
Lassen

(10) Patent No.: US 7,475,875 B2
(45) Date of Patent: Jan. 13, 2009

(54) APPARATUS AND METHOD FOR SEPARATING PRINTING PLATES

(75) Inventor: Bernd Lassen, Mönkeberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 411 days.

(21) Appl. No.: 11/435,384

(22) Filed: May 16, 2006

(65) Prior Publication Data

US 2007/0023990 A1 Feb. 1, 2007

(30) Foreign Application Priority Data

Jul. 28, 2005 (DE) ..... 10 2005 035 325

(51) Int. Cl.
*B65H 5/08* (2006.01)

(52) U.S. Cl. ..... 271/11; 271/91; 271/93

(58) Field of Classification Search ..... 271/11, 271/91, 93, 94, 95, 103, 106
See application file for complete search history.

(56) References Cited

U.S. PATENT DOCUMENTS

| | | | | |
|---|---|---|---|---|
| 5,367,360 | A * | 11/1994 | McIlwraith et al. | 355/85 |
| 6,729,237 | B2 * | 5/2004 | Kawamura et al. | 101/477 |
| 6,739,588 | B2 * | 5/2004 | Koster et al. | 271/106 |
| 6,886,827 | B2 * | 5/2005 | Dachtler | 271/106 |
| 6,929,258 | B2 * | 8/2005 | Ono et al. | 271/91 |
| 7,044,056 | B2 * | 5/2006 | Miyoshi | 101/477 |
| 7,152,531 | B2 * | 12/2006 | Miyoshi | 101/477 |
| 2002/0096815 | A1 * | 7/2002 | Dachtler | 271/3.11 |
| 2003/0011123 | A1 | 1/2003 | Behrens et al. | |
| 2005/0230901 | A1 | 10/2005 | Lassen | |

FOREIGN PATENT DOCUMENTS

| | | | |
|---|---|---|---|
| DE | 101 34 151 | A1 | 1/2003 |
| DE | 10 2004 015 195 | A1 | 11/2005 |
| EP | 1 154 327 | A2 | 11/2001 |
| EP | 1 426 832 | A2 | 6/2004 |

* cited by examiner

*Primary Examiner*—Kaitlin S Joerger
(74) *Attorney, Agent, or Firm*—Laurence A. Greenberg; Werner H. Stemer; Ralph E. Locher

(57) ABSTRACT

An apparatus for separating printing plates which are separated from one another in a stack, preferably individually by intermediate layers, has a lifting device for raising a printing plate or an intermediate layer from the stack. The apparatus further has a separating device for the intermediate layers, in particular as a constituent part of a loading device of a unit for setting images on printing plates. The separating device is configured as a rocker which can be pivoted onto the lifting device and can be pivoted away from the lifting device and contains suction elements and one drivable transport roller. An adhering intermediate layer is pulled off from the printing plate with the suction elements, and the intermediate layer is transported away with the transport roller.

14 Claims, 5 Drawing Sheets

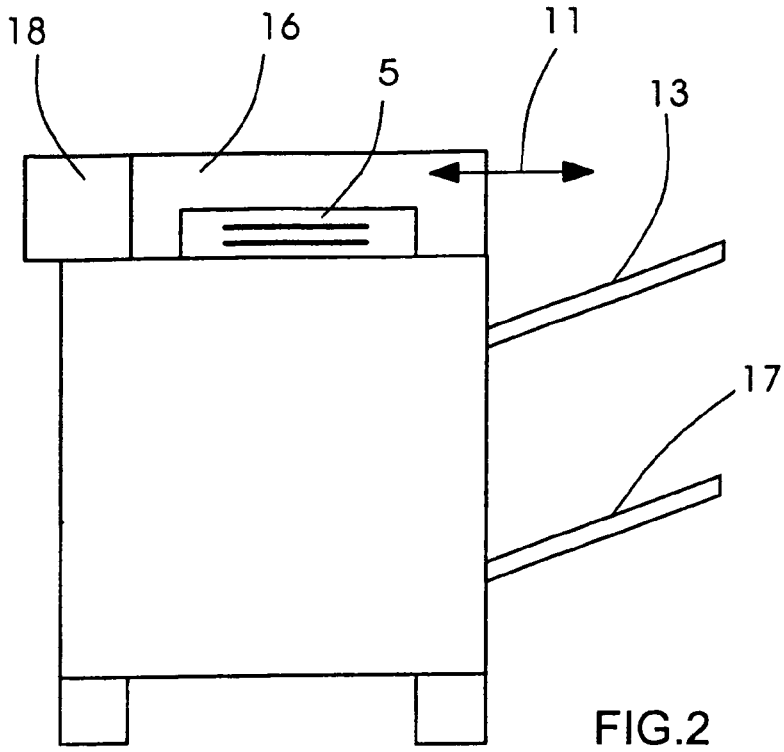
FIG.2
FIG.3
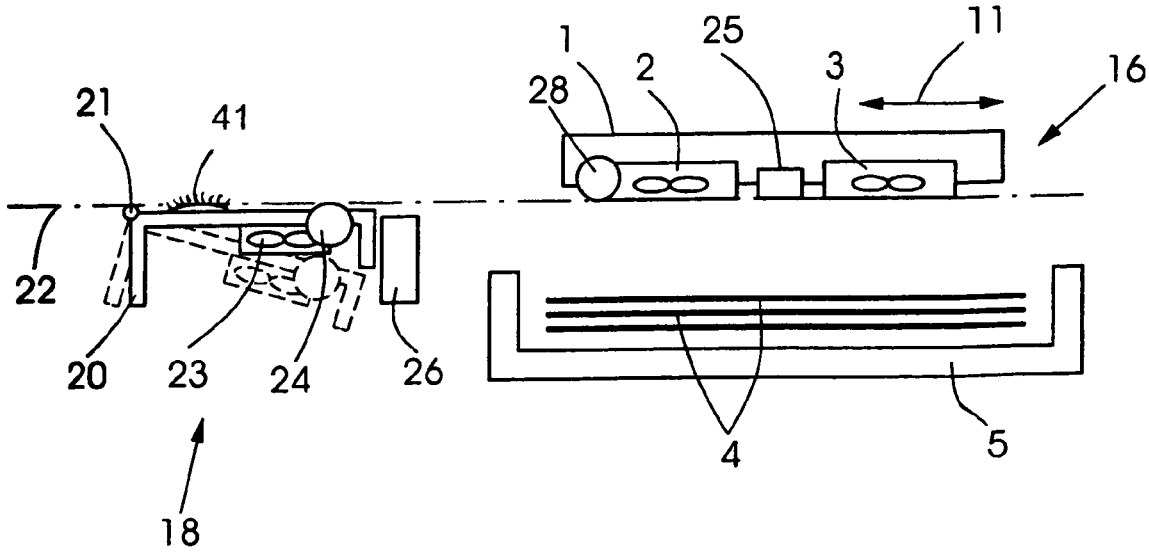

APPARATUS AND METHOD FOR SEPARATING PRINTING PLATES

BACKGROUND OF THE INVENTION

Field of the Invention

The invention relates to an apparatus and a method for separating printing plates which are separated from one another in a stack, preferably by intermediate layers. The apparatus has a lifting device with at least one suction element for raising a printing plate from the stack, and a separating device for the intermediate layers, in particular as a constituent part of a loading device of a unit for setting images on printing plates.

An apparatus of the above-mentioned generic type is known from the published, non-prosecuted German patent application DE 10 2004 015 195.4 A1, corresponding to U.S. patent publication No. 2005/0230901 A1.

The lifting device of the known apparatus has at least two suction elements which are independent of one another, of which one suction element can be pivoted or angled away relative to the other suction elements. If the suction elements are angled away with respect to one another after attracting the printing plates by suction and raising them, the printing plate which is attracted by suction is bent somewhat as a result. As a result of the bending, an object which still adheres to the printing plate falls off, which object could be an intermediate layer or a further printing plate. This can therefore obviate the need for a separate separating device for the intermediate layers.

Nevertheless, an additional separating device for separating and transporting the intermediate layers away is appropriate, in order to ensure a reliable and controlled operation for all types of printing plates and intermediate layers during the separation of printing plates.

SUMMARY OF THE INVENTION

It is accordingly an object of the invention to provide an apparatus and a method for separating printing plates which overcome the above-mentioned disadvantages of the prior art devices and methods of this general type, which has a separating device configured to be as compact as possible, preferably also for easy retrofitting.

With the foregoing and other objects in view there is provided, in accordance with the invention, an apparatus for separating printing plates stacked in a tray alone and/or for separating printing plates stacked in the tray separated from one another individually by intermediate layers. The apparatus contains a lifting device for raising a printing plate or an intermediate layer from a stack. The lifting device contains at least one suction head and is moveable in a movement plane in a substantially horizontal direction. A separating device is provided for removing the intermediate layers. The separating device has a rocker being pivotable to the movement plane and being pivotable away from the movement plane. The rocker contains at least one suction element and one drivable transport roller.

According to the invention, the object is achieved in that the separating device is configured as a rocker which can pivot to and away from the lifting device, attracts an intermediate layer by suction by suction elements, which intermediate layer adheres to a printing plate and is composed of paper as a rule, peels the intermediate layer from the printing plate by pivoting the rocker away, and transports it into a collecting container by a driven transport roller.

A sensor, preferably an ultrasound sensor, detects whether the lifting device has gripped only one printing plate, only one intermediate layer or an adhering combination of the printing plate and the intermediate layer. Depending on the situation which is detected, different methods are started for the possibly necessary separation of the printing plate and the intermediate layer and for the further transport of the materials.

Other features which are considered as characteristic for the invention are set forth in the appended claims.

Although the invention is illustrated and described herein as embodied in an apparatus and a method for separating printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is a diagrammatic, side view of an external drum exposer having the lifting device and a separating device positioned thereon according to the invention;

FIG. 3 is a diagrammatic, vertical sectional view through the separating device and the lifting device;

DESCRIPTION OF THE PREFERRED EMBODIMENTS

Figure 1:
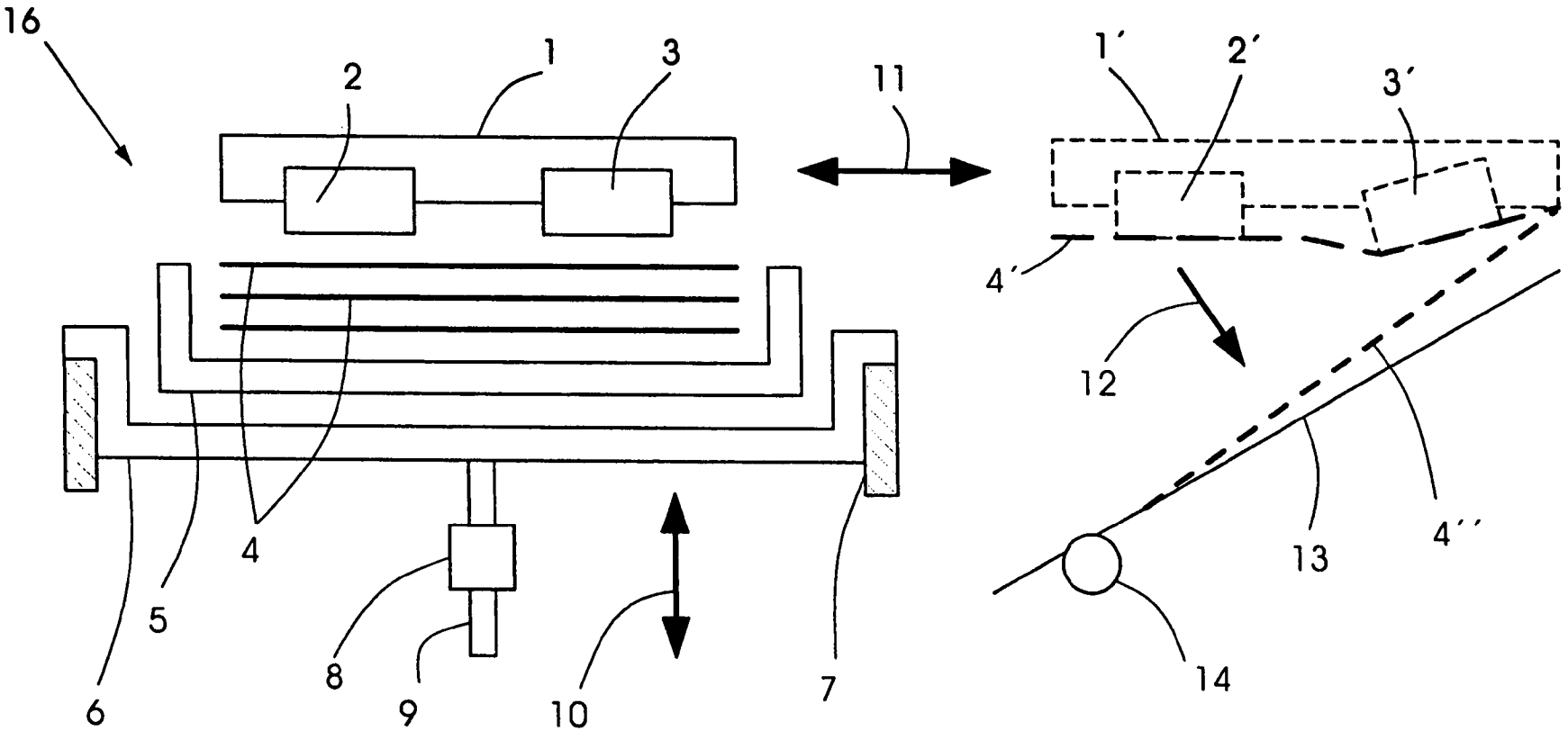
FIG.1 Prior Art
FIG. 1 is a diagrammatic, vertical sectional view through a lifting device of a unit for setting images on printing plates according to the prior art.

Referring now to the figures of the drawing in detail and first, particularly, to FIG. 1 thereof, there is shown a diagrammatic vertical sectional view through a lifting device 16 above an entry slide of a unit for setting images on printing plates, as is known from the published, non-prosecuted German patent application DE 10 2004 015 195.4 A1.

The lifting device 16 contains a suction unit 1 with suction heads 2, 3 above a stack of printing plates 4, which stack is positioned on a tray 5 which for its part is pushed into a type of shell 6. The tray 5 can also be a cassette which is open on its upper side.

The shell 6 is mounted on springs 7 and can be moved to and fro with an actuator 8 along a guide 9 in the direction of a double arrow 10, in order to keep the printing plate level uniform as the stack height changes.

The suction unit 1 can be moved horizontally in a direction of double arrow 11 while driving a printing plate 4' which is attracted by suction, to be precise until over an entry slide 13 of a unit (not shown in greater detail) for setting images on printing plates. The moved suction unit 1' with its suction heads 2', 3' is shown with dashed lines, in the same way as the printing plate 4' attracted by suction.

As shown, the suction head 3' can be angled or tilted with respect to the suction head 2', with the result that the printing plate 4' is bent or tilted slightly in the intermediate region by both suction heads 2', 3'. As the printing plate 4' is no longer flat as a result, an object which possibly adheres to the underside falls off. This does not necessarily have to happen above the entry slide 13, but can also happen at a different location. For example, the suction unit 1 in the illustration of FIG. 1 could be moved initially to the left to the side which faces away from the entry slide 13, in order to discharge, for example, an intermediate layer there which adheres to the printing plate 4', and could subsequently move into the position over the entry slide 13. The printing plate 4' is also pretensioned there in the direction of an arrow 12 toward the entry slide by the tilting of the suction head 3'. If the suction head 2' is then switched off and the printing plate 4' is still held only by the suction head 3', that edge of the printing plate 4' which is then free falls initially onto the entry slide 13 in the direction of the arrow 12. If the suction head 3' is also switched off subsequently, the printing plate falls completely onto the entry slide 13; the printing plate will be situated transitionally approximately in the position 4" before it rests flat on the entry slide 13. On the entry slide 13, the printing plate 4" is then conveyed into the unit for setting images on printing plates via the assistance of transport rollers 14.

FIG. 2 shows a side view of an external drum exposer for printing plates, onto which the lifting device 16 has been positioned. The cassette 5 with printing plates is pushed in under the lifting device 16. The lifting device 16 contains the suction unit 1 which cannot be seen in FIG. 2, however, and which can be moved along the double arrow 11 over the entry slide 13. After image setting, the printing plates can be removed from a printing plate delivery device 17.

According to the invention, a separating device 18 for the intermediate layers is added to the loading device, which separating device 18 operates in conjunction with the lifting device 16 described. The separating device 18 is preferably disposed at the level of the lifting device 16 on that side of the printing plate exposer which lies opposite the entry slide 13 (see FIG. 2).

FIG. 3 shows a diagrammatic vertical section through a preferred embodiment of the separating device 18 together with the lifting device 16. The separating device 18 contains a pivotable rocker 20 which can be pivoted about a pivot point 21 onto the horizontal movement plane 22 of the lifting device 16 or can be pivoted away from the movement plane 22 (shown with dashed lines in FIG. 3). The pivoting movement is carried out by a non-illustrated pivoting drive, for example by an electric motor. At least one suction element 23 is integrated into the rocker 20, with which suction element 23 an object which lies on the upper side of the rocker 20 can be attracted by suction via non-illustrated suction holes in the rocker 20. Suction fans or else suction cups which are connected to a vacuum generator can be used, for example, as the suction elements 23. Furthermore, the rocker 20 contains a driven transport roller 24 for transporting away the object which rests on it. Discharge brushes 41 for conducting away an electrostatic charge from the object which is being transported away can also be integrated into the transport roller 24 or into the rocker 20.

The lifting device 16 is provided with a first sensor 25, for example with a capacitive sensor, which can be used to detect whether the object which is raised by the lifting device 16 or, in the case of a plurality of adhering objects, the uppermost of the raised objects is a printing plate or an intermediate layer. Furthermore, a second sensor 26, for example an ultrasound sensor, is attached in the vicinity of the separating device 18, which second sensor 26 can be used to detect whether a plurality of adhering objects have been raised by the lifting device 16. To this end, the raised objects are moved by the lifting device 16 over the second sensor 26 in the movement plane 22. The first sensor 25 and the second sensor 26 can be used together to detect the different possible situations, namely whether:

only one printing plate has been raised;

only one intermediate layer has been raised;

a printing plate has been raised together with an intermediate layer which adheres to the bottom of the former;

an intermediate layer has been raised together with a printing plate which adheres to the bottom of the former; and a printing plate has been raised together with a plurality of intermediate layers and/or printing plates which adhere to the bottom of the former.

If only one printing plate has been raised, the printing plate is transported horizontally by the lifting device 16 over the entry slide 13 and is deposited into the entry slide 13.

Figure 4:
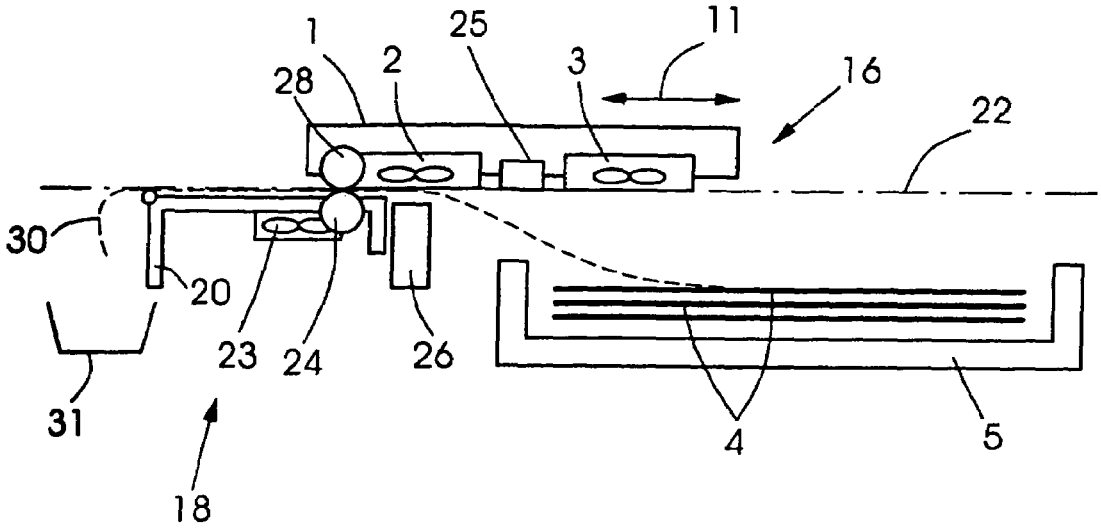
FIG. 4 is an illustration of an intermediate layer being transported away.

FIG. 4 shows the situation where only one intermediate layer 30 has been raised. In this case, the intermediate layer 30 is transported horizontally by the lifting device 16 over the separating device 18, and the rocker 20 is pivoted into the movement plane 22, with the result that the intermediate layer 30 is clamped between the transport roller 24 and a back pressure roller 28 which is attached to the lifting device 16.

After the suction unit 1 is switched off, the intermediate layer 30 is then transported away into a collecting container 31 by the transport roller 24.

Figure 5:
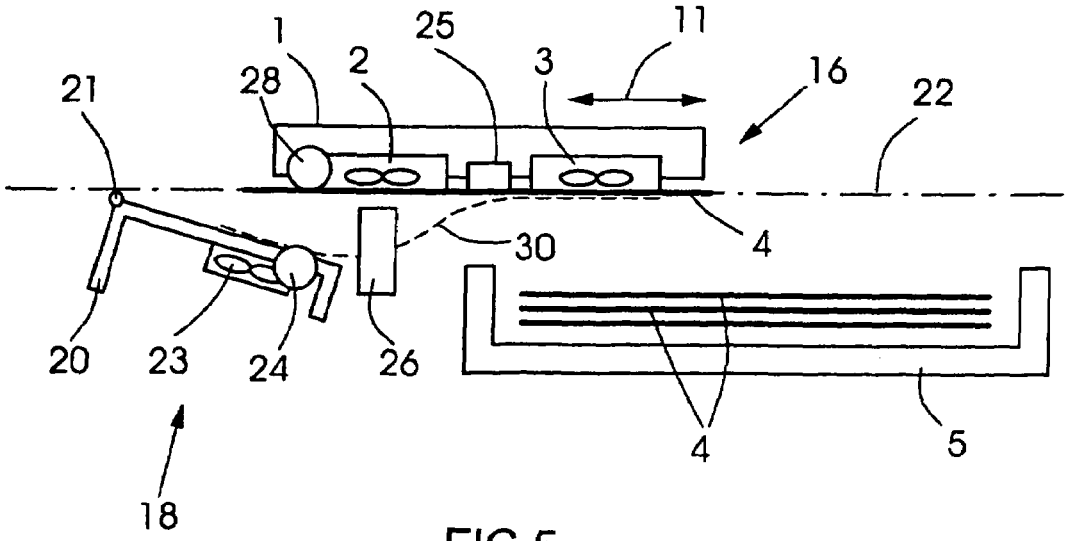
FIG. 5 is an illustration showing an adhering intermediate layer being separated.

FIG. 5 shows the situation where a printing plate 4 has been raised together with an intermediate layer 30 which adheres to the bottom of the printing plate. First, the two adhering objects are transported horizontally by the lifting device 16 over the separating device 18, and the rocker 20 is pivoted into the movement plane 22. The adhering intermediate layer 30 is then attracted by suction with the suction elements 23, and the rocker 20 is pivoted away from the movement plane 22 again, the intermediate layer 30 being peeled partially from the printing plate 4. Subsequently, the lifting device 16 transports the printing plate 4 over the entry slide 13 and deposits it there. Here, the intermediate layer 30 continues to be held firmly by the suction elements 23, with the result that it is detached completely from the printing plate 4 during the transport of the printing plate 4. After this, the lifting device 16 is positioned over the separating device 18, and the rocker 20 is pivoted into the movement plane 22 again, with the result that the intermediate layer 30 is clamped between a transport roller 24 and a back pressure roller 28. After the suction unit 1 and the suction elements 23 are switched off, the intermediate layer 30 is transported away into the collecting container 31, as is shown in FIG. 4.

Figure 6:
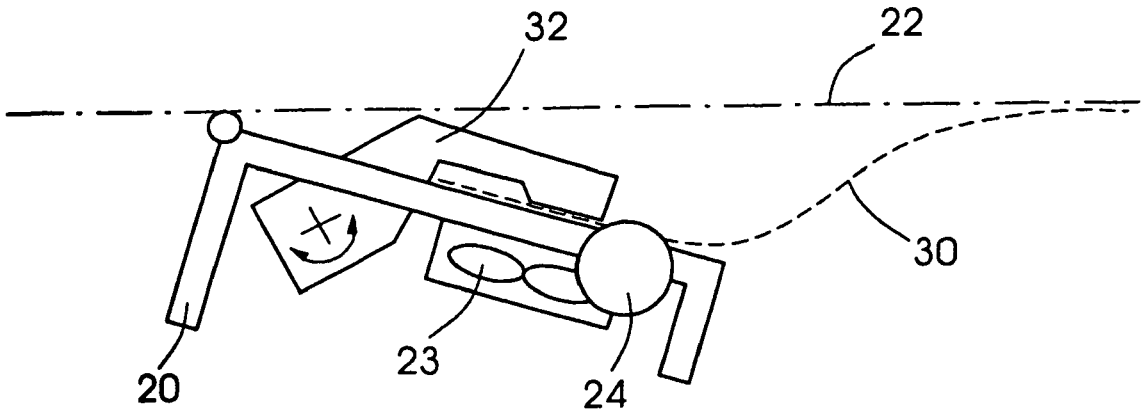
FIG. 6 is an illustration showing the separating device having an additional clamping jaw.

The firm holding of the intermediate layer 30 while the printing plate 4 is being transported away can also be assisted by a clamping jaw 32 which is integrated additionally into the rocker 20, as is shown in FIG. 6. The clamping jaw 32 is mounted rotatably in the rocker 20 and clamps the intermediate layer 30 firmly on the upper side of the rocker 20. The clamping jaw 32 is preferably coupled mechanically to the pivoting movement of the rocker 20, in such a way that it is moved into the shown clamping position when the rocker 20 is pivoted away from the movement plane 22. This mechanical coupling could take place, for example, by gearwheels which convert the pivoting movement of the rocker 20 into a suitable rotational movement of the clamping jaw 32.

Figure 7:
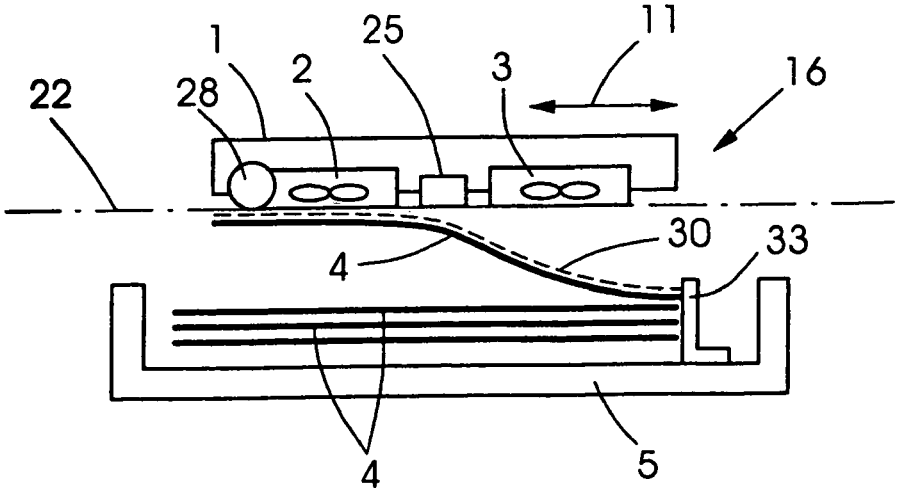
FIG. 7 is an illustration showing an adhering printing plate being detached.

FIG. 7 shows the situation where an intermediate layer 30 has been raised together with a printing plate 4 which adheres to the bottom of the intermediate layer. In this case, the raised intermediate layer 30 and the adhering printing plate 4 are positioned over the tray 5 by the lifting device 16. The suction head 3 is then switched off, with the result that those ends of the intermediate layer 30 and the printing plate 4 which are no longer attracted by suction hang down into the tray 5. A stop 33 is situated in the tray 5, against which stop 33 the lifting device 16 subsequently moves both raised objects. Here, the printing plate 4 is blocked by the stop 33 and, during the further movement of the lifting device 16 (to the right in FIG. 7), the printing plate 4 is detached from the intermediate layer 30 and falls back into the tray 5. After this, the intermediate layer 30 is transported horizontally by the lifting device 16 over the separating device 18, and the intermediate layer 30 is transported away into the collecting container 31 using the process which is explained with reference to FIG. 4.

Figure 8:
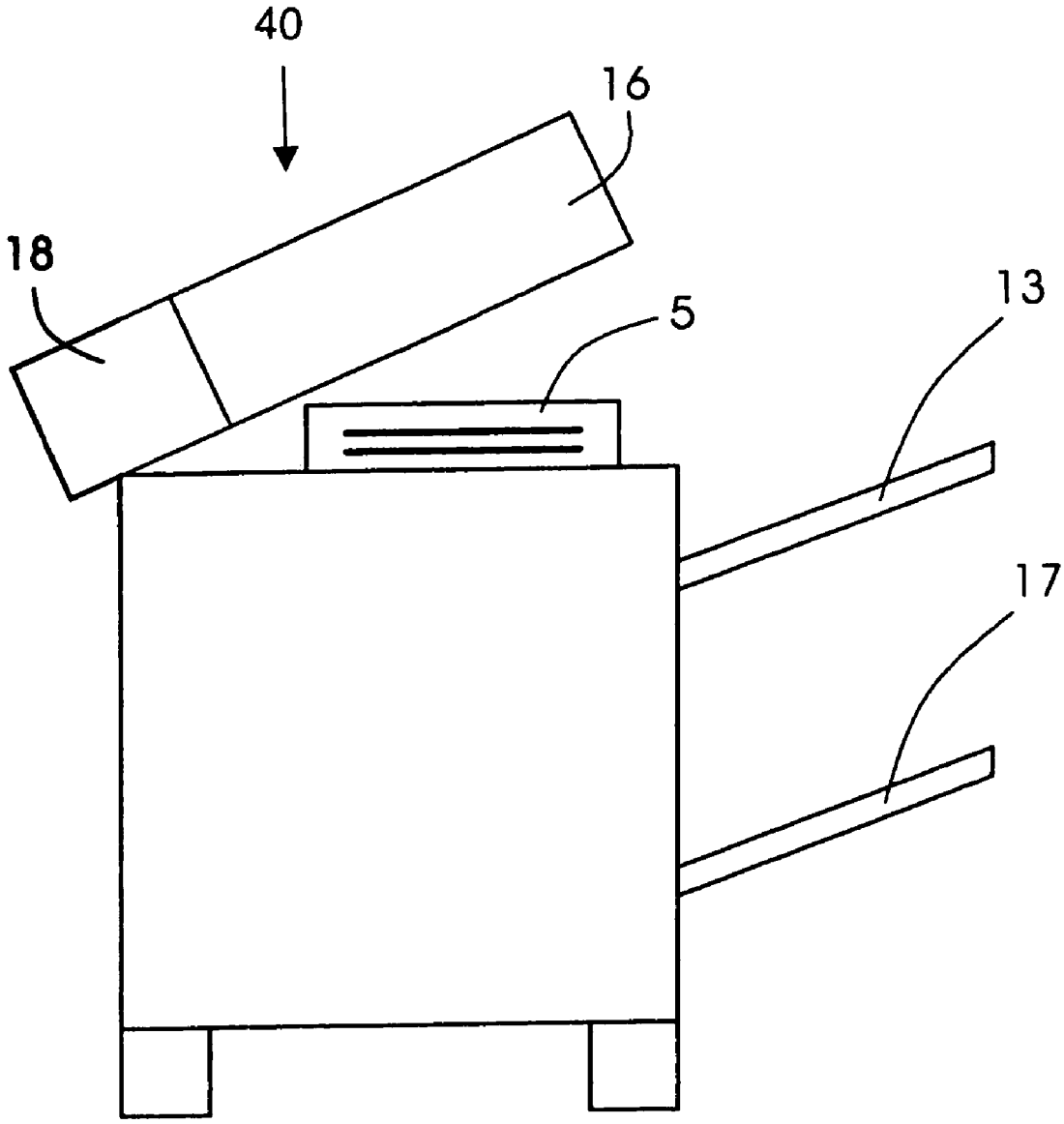
FIG. 8 is a diagrammatic, side view of the external drum exposer having the lifting device and the separating device integrated into the cover.

If a printing plate has been raised together with a plurality of intermediate layers and/or printing plates which adhere to the bottom of the former, the loading device outputs a disruption signal, in order that the operator can intervene and eliminate the disruption manually. In order to make this easier, the lifting device 16 and the separating device 18 are advantageously integrated into a cover 40 of the printing plate exposer. The lower side of the lifting device 16 and the separating device 18 are made readily accessible to the operator by folding up the cover 40 (FIG. 8).

This application claims the priority, under 35 U.S.C. § 119, of German patent application No. 10 2005 035 325.8, filed Jul. 28, 2005; the entire disclosure of the prior application is herewith incorporated by reference.

I claim:

1. An apparatus for separating printing plates stacked in a tray alone and/or for separating printing plates stacked in the tray separated from one another individually by intermediate layers, the apparatus comprising:

a lifting device for raising a printing plate or an intermediate layer from a stack, said lifting device containing at least one suction head and being moved in a movement plane in a substantially horizontal direction; and a separating device for removing the intermediate layers, said separating device having a rocker being pivotable to the movement plane and being pivotable away from the movement plane, said rocker containing at least one suction element and one drivable transport roller.

2. The apparatus according to claim 1, wherein said lifting device has a back pressure roller for operating in conjunction with said transport roller.

3. The apparatus according to claim 1, further comprising discharge brushes integrated into said rocker or into said transport roller.

4. The apparatus according to claim 1, wherein said rocker includes a clamping jaw, a movement of said clamping jaw is coupled mechanically to a pivoting movement of said rocker.

5. The apparatus according to claim 1, wherein said lifting device has a first sensor for detecting an uppermost object raised by said lifting device.

6. The apparatus according to claim 5, further comprising a second sensor for detecting whether a plurality of objects adhering to one another have been raised by said lifting device.

7. The apparatus according to claim 1, further comprising a stop disposed in the tray.

8. The apparatus according to claim 1, wherein said separating device and said lifting device are a constituent part of a loading device of a unit for setting images on printing plates.

9. The apparatus according to claim 1, further comprising a cover, said lifting device and said separating device are integrated into said cover, which can be pivoted away, of a unit for exposing printing plates.

10. A method for separating printing plates stacked in a tray alone and/or for separating printing plates stacked in the tray separated from one another individually by intermediate layers, which comprises the steps of:

providing an apparatus for separating the printing plates stacked in the tray, the apparatus including a lifting device for raising a printing plate or an intermediate layer from a stack, the lifting device containing at least one suction head and being moved in a movement plane in a substantially horizontal direction, the apparatus further including a separating device for removing the intermediate layers, the separating device having a rocker being pivotable to the movement plane and being pivotable away from the movement plane, the rocker containing at least one suction element and one drivable transport roller;

providing a first sensor and a second sensor for detecting whether the lifting device:

(a) has raised only one printing plate;

(b) has raised only one intermediate layer;

(c) has raised a printing plate together with an intermediate layer adhering to a bottom of the printing plate;

(d) has raised an intermediate layer together with a printing plate adhering to a bottom of the intermediate plate; or (e) has raised a printing plate together with a plurality of intermediate layers and/or printing plates which adhere to the bottom of the printing plate.

11. A method for separating printing plates stacked in a tray alone and/or for separating printing plates stacked in the tray separated from one another individually by intermediate layers, which comprises the steps of:

providing an apparatus for separating the printing plates stacked in the tray, the apparatus including a lifting device for raising a printing plate or an intermediate layer from a stack, the lifting device containing at least one suction head and being moved in a movement plane in a substantially horizontal direction, the apparatus further including a separating device for removing the intermediate layers, the separating device including a rocker being pivotable to the movement plane and being pivotable away from the movement plane, the rocker containing at least one suction element and one drivable transport roller;

transporting the intermediate layer via the lifting device over the separating device;

pivoting the rocker into the movement plane;

clamping the intermediate layer between the drivable transport roller and a back pressure roller; and transporting away the intermediate layer via the drivable transport roller.

12. A method for separating printing plates stacked in a tray alone and/or for separating printing plates stacked in the tray separated from one another individually by intermediate layers, which comprises the steps of:

providing an apparatus for separating the printing plates stacked in the tray, the apparatus including a lifting device for raising a printing plate or an intermediate layer from the stack, the lifting device containing at least one suction head and being moved in a movement plane in a substantially horizontal direction, the apparatus further including a separating device for removing the intermediate layers, the separating device having a rocker being pivotable to the movement plane and being pivotable away from the movement plane, the rocker containing at least one suction element and one drivable transport roller;

transporting the printing plate and the intermediate layer adhering to a bottom of the printing plate via the lifting device over the separating device;

pivoting the rocker into the movement plane;

attracting the intermediate layer via suction with the at least one suction element and holding the intermediate layer firmly on the rocker;

pivoting the rocker away again from the movement plane, resulting in the intermediate layer being peeled from the printing plate; and transporting the printing plate away with the lifting device from the separating device, the intermediate layer and the printing plate being separated from one another.

13. The method according to claim 12, which further comprises additionally holding the intermediate layer firmly on the rocker with a clamping jaw.

14. A method for separating printing plates stacked in a tray alone and/or for separating printing plates stacked in the tray separated from one another individually by intermediate layers, which comprises the steps of:

providing an apparatus for separating the printing plates stacked in a tray, the apparatus including a lifting device for raising a printing plate or an intermediate layer from a stack, the lifting device containing at least one suction head and being moved in a movement plane in a substantially horizontal direction, the apparatus further including a separating device for removing the intermediate layers, the separating device having a rocker being pivotable to the movement plane and being pivotable away from the movement plane, the rocker containing at least one suction element and one drivable transport roller;

transporting the intermediate layer and the printing plate adhering to a bottom of the intermediate layer via the lifting device over the tray;

switching off the at least one suction head with a result that ends of the intermediate layer and the printing plate which are no longer attracted by suction hang down into the tray; and moving the intermediate layer and the printing plate against a stop via the lifting device, resulting in the intermediate layer and the printing plate being separated from one another.

* * * * *